US011832660B2

(12) United States Patent
Tokunaga et al.

(10) Patent No.: US 11,832,660 B2
(45) Date of Patent: Dec. 5, 2023

(54) GARMENT HAVING AN INTERNAL AIRFLOW SPACE BETWEEN INNER AND OUTER FABRICS AND A SEPARATE HEAT INSULATION MATERIAL IN THE INTERNAL AIRFLOW SPACE

(71) Applicants: MAKITA CORPORATION, Anjo (JP); TEIJIN LIMITED, Osaka (JP)

(72) Inventors: Manabu Tokunaga, Anjo (JP); Kazuhiro Sakurai, Anjo (JP); Natsumi Hara, Anjo (JP); Nobuyoshi Miyasaka, Osaka (JP)

(73) Assignees: MAKITA CORPORATION, Anjo (JP); TEIJIN LIMITED, Osaka (JP)

( * ) Notice: Subject to any disclaimer, the term of this patent is extended or adjusted under 35 U.S.C. 154(b) by 301 days.

(21) Appl. No.: 17/041,378

(22) PCT Filed: Mar. 8, 2019

(86) PCT No.: PCT/JP2019/009530
§ 371 (c)(1),
(2) Date: Sep. 24, 2020

(87) PCT Pub. No.: WO2019/198396
PCT Pub. Date: Oct. 17, 2019

(65) Prior Publication Data

US 2021/0120890 A1 Apr. 29, 2021

(30) Foreign Application Priority Data

Apr. 12, 2018 (JP) ..... 2018-077020

(51) Int. Cl.
*A41D 13/005* (2006.01)
*A41D 13/002* (2006.01)
*F04D 29/64* (2006.01)

(52) U.S. Cl.
CPC ..... *A41D 13/005* (2013.01); *A41D 13/0025* (2013.01); *A41D 2400/10* (2013.01); *F04D 29/646* (2013.01)

(58) Field of Classification Search
CPC .. A41D 13/00; A41D 13/002; A41D 13/0025; A41D 13/005; A41D 2400/10
See application file for complete search history.

(56) References Cited

U.S. PATENT DOCUMENTS 5,758,363 A * 6/1998 Winfree ..... A41D 13/0015 2/108
7,124,593 B2 * 10/2006 Feher ..... A41D 13/0025 62/3.5

(Continued)

FOREIGN PATENT DOCUMENTS

CN 1638656 A 7/2005
CN 202019801 U 11/2011

(Continued)

OTHER PUBLICATIONS

English translation of WO2006098429, obtained via espacenet.com (last visited Jan. 12, 2023) (Year: 2022).*

(Continued)

*Primary Examiner* — Patrick J. Lynch
(74) *Attorney, Agent, or Firm* — Oliff PLC

(57) ABSTRACT

A garment, to which a blower device is detachably attachable, includes a main body and a heat insulation material. The main body includes at least an outer fabric having an attachment hole through which the blower device can be partially inserted. The main body is configured to cover at least a portion of a body of a wearer. The heat insulation material is attached to the main body at least on an inner side of the outer fabric. The heat insulation material is configured to cover at least a portion of the body. The garment is (Continued)

configured such that the heat insulation material is detachable from the main body.

9 Claims, 6 Drawing Sheets

(56) References Cited

U.S. PATENT DOCUMENTS

| | | | | |
|---|---|---|---|---|
| 7,357,135 | B2 * | 4/2008 | Cunningham | A62B 17/04 128/201.29 |
| 2005/0143796 | A1 * | 6/2005 | Augustine | F16L 37/098 607/104 |
| 2005/0223463 | A1 * | 10/2005 | Mordecai | A41D 13/002 2/81 |
| 2006/0080987 | A1 | 4/2006 | Ichigaya | |
| 2006/0162041 | A1 * | 7/2006 | Tengbom | A41F 5/00 2/85 |
| 2007/0050878 | A1 | 3/2007 | Ichigaya | |
| 2008/0201818 | A1 * | 8/2008 | Nilforushan | A61F 7/02 607/114 |
| 2010/0242147 | A1 * | 9/2010 | Pohr | A41D 13/0025 2/69 |
| 2013/0081192 | A1 * | 4/2013 | Den Dekker | A41D 27/285 2/69 |
| 2016/0135517 | A1 | 5/2016 | Silverberg | |
| 2017/0273372 | A1 * | 9/2017 | Deng | A41D 13/1236 |
| 2019/0166928 | A1 | 6/2019 | Miwa et al. | |

FOREIGN PATENT DOCUMENTS

| | | | | |
|---|---|---|---|---|
| CN | 102940326 | A | 2/2013 | |
| CN | 103251142 | A | 8/2013 | |
| CN | 104287236 | A | 1/2015 | |
| CN | 204070619 | U | 1/2015 | |
| CN | 205492708 | U | 8/2016 | |
| DE | 9104142 | U1 * | 9/1991 | A41D 13/002 |
| JP | S58-105410 | U | 7/1983 | |
| JP | 2005-054299 | A | 3/2005 | |
| JP | 3118697 | U | 2/2006 | |
| JP | 2006-152452 | A | 6/2006 | |
| JP | 3144098 | U | 8/2008 | |
| JP | 2008-240214 | A | 10/2008 | |
| JP | 6159047 | B1 | 7/2017 | |
| TW | 200913912 | A | 4/2009 | |
| WO | WO-2006070814 | A1 * | 7/2006 | A41D 13/002 |
| WO | WO-2006098429 | A1 * | 9/2006 | A41D 13/0025 |
| WO | WO-2007005391 | A2 * | 1/2007 | A41D 13/0025 |
| WO | 2018/025784 | A1 | 2/2018 | |

OTHER PUBLICATIONS

English translation of JP2008240214 to Ueda, obtained via https://www.j-platpat.inpit.go.jp/ (last visited May 10, 2023) (Year: 2023).*

Jul. 12, 2022 Office Action issued in Japanese Patent Application No. 2018-077020.

Oct. 13, 2020 International Preliminary Report on Patentability issued in International Patent Application No. PCT/JP2019/009530.

Mar. 15, 2022 Office Action issued in Japanese Patent Application No. 2018-077020.

Jul. 13, 2022 Office Action issued in Chinese Patent Application No. 201980024230.2.

Feb. 21, 2022 Office Action issued in Chinese Patent Application No. 201980024230.2.

Jun. 1, 2021 Notification of Written Submission of Publications issued in Japanese Patent Application No. 2018-077020.

Apr. 5, 2021 Written Submission of Publications issued in Japanese Patent Application No. 2018-077020.

May 28, 2019 International Search Report issued in International Patent Application No. PCT/JP2019/009530.

Apr. 14, 2021 Search Report issued in European Patent Application No. 19784349.3.

Apr. 26, 2021 Office Action issued in European Patent Application No. 19784349.3.

Dec. 6, 2022 Office Action issued in Chinese Patent Application No. 201980024230.2.

* cited by examiner

GARMENT HAVING AN INTERNAL AIRFLOW SPACE BETWEEN INNER AND OUTER FABRICS AND A SEPARATE HEAT INSULATION MATERIAL IN THE INTERNAL AIRFLOW SPACE

TECHNICAL FIELD

The present invention relates to a garment to which a blower device is detachably attachable.

BACKGROUND ART

A garment to which a blower device is detachably attachable is known (for example, Japanese Unexamined Patent Application Publication No. 2005-054299). In such a garment, air is delivered into the garment by a blower device, so that a body of a wearer of the garment can be cooled.

SUMMARY OF THE INVENTION

Problem to be Solved by the Invention

The garment described above can provide comfortability to the wearer when worn under a high-temperature environment. However, the comfortability of the garment when it is worn under a low-temperature environment is not considered, and therefore the environment suitable for wearing the garment may be limited.

An object of the present invention is, in consideration of the problem described above, to provide a garment capable of providing comfortability when the garment is worn under various environments.

Solution to Problem

One aspect of the present invention provides a garment to which a blower device is detachably attachable. The garment includes a main body and a heat insulation material. The main body includes at least an outer fabric, and the main body is configured to cover at least a portion of a body of a wearer. The outer fabric has an attachment hole through which the blower device can be partially inserted. The heat insulation material is attached to the main body at least on an inner side of the outer fabric, and configured to cover at least a portion of the body of the wearer. The garment is formed such that the heat insulation material is detachable from the main body.

The garment of this aspect can be used for cooling the body of the wearer under a high-temperature environment by detaching the heat insulation material and attaching the blower device to the main body. In addition to this, the garment can be used as a cold-weather garment under a low-temperature environment by attaching the heat insulation material to the main body. Thus, the comfortability when worn can be provided not only under the high-temperature environment but also under the low-temperature environment.

In one aspect of the present invention, the heat insulation material may be attachable to the main body to cover the attachment hole. In a case in which the garment is used as a cold-weather garment by attaching the heat insulation material to the main body, it may be preferable that the blower device is detached from the main body because the garment can be reduced in weight and the mobility can be improved. According to this aspect, when the blower device is detached, the attachment hole can be covered by the heat insulation material, so that the cool air can be prevented from passing through the attachment hole and hitting the body of the wearer.

In one aspect of the present invention, a heat generator may be detachably attachable to at least one of the main body and the heat insulation material. According to this aspect, not only the heat insulation function (heat retaining function) is achieved by the heat insulation material but also a warming function can be added, as needed, to the garment by the heat generator. Thus, for example, in a case in which the cold protection using the heat insulation material is insufficient, the heat generator attached to the main body or the heat insulation material can warm the body of the wearer efficiently. Consequently, the comfortability under the low-temperature environment can be further improved.

In the one aspect of the present invention, at least one of the main body and the heat insulation material may have a positioning part configured to hold the heat insulation material at a predetermined position relative to the main body. According to this aspect, the heat insulation material can be positioned relative to the main body by the positioning part, and thereby a positional relation between the heat insulation material and the main body when the heat insulation material is attached to the main body can be stabilized. Consequently, the comfortability when worn can be improved.

In one aspect of the present invention, the positioning part may be provided on the heat insulation material and configured to be engaged with the attachment hole to hold the heat insulation material at the predetermined position relative to the main body. According to this aspect, the heat insulation material can be easily positioned relative to the main body by using the attachment hole formed in the main body, so that the positional relation can be stabilized.

In one aspect of the present invention, the positioning part may be formed as a pocket that is capable of storing an article and that is to be disposed on an outer side of the outer fabric through the attachment hole. According to this aspect, the pocket can be used for storing an article, in addition to the positioning relative to the main body. Also, the pocket can achieve a concealing function for concealing the attachment hole by being arranged through the attachment hole. The pocket in this aspect may be fixed by means of sewing to the heat insulation material or may be detachably attached to the heat insulation material.

In one aspect of the present invention, the main body may include an inner fabric attached to an inner surface side of the outer fabric, and an internal space formed between the outer fabric and the inner fabric. The internal space may be configured to allow air to flow within the internal space, when the blower device is attached to the garment and the air is delivered by the blower device which is partially inserted through the attachment hole. Further, the heat insulation material may be disposed in the internal space. This aspect can allow the air delivered by the blower device to flow within the internal space to cool the body of the wearer under the high-temperature environment, and allow the heat insulation material to be attached to the main body utilizing the internal space under the low-temperature environment.

In one aspect of the present invention, the main body may have an opening that allows the internal space to communicate with an outside. Further, the opening may be configured to be openable and closeable. According to this aspect, under the high-temperature environment, when the opening is opened, a specific portion of the body of the wearer can be selectively cooled by the air that is delivered by the blower device to the internal space and flows out from the opening. Further, under the low-temperature environment, when the opening is closed, leakage of warmed air from the internal space can be suppressed as much as possible, so that deterioration of the heat insulation property (heat-retaining property) can be prevented.

In the one aspect of the present invention, the garment may include at least one pocket configured to be detachably attachable to at least one of the main body and the heat insulation material. According to this aspect, the pocket can be added to the garment as needed and used for storing an article.

DESCRIPTION OF EMBODIMENTS

Hereinafter, embodiments of the present invention will be described with reference to the drawings. In the embodiments described below, a jacket 1 is exemplarily described as an example of a garment according to the present invention.

Figure 1:
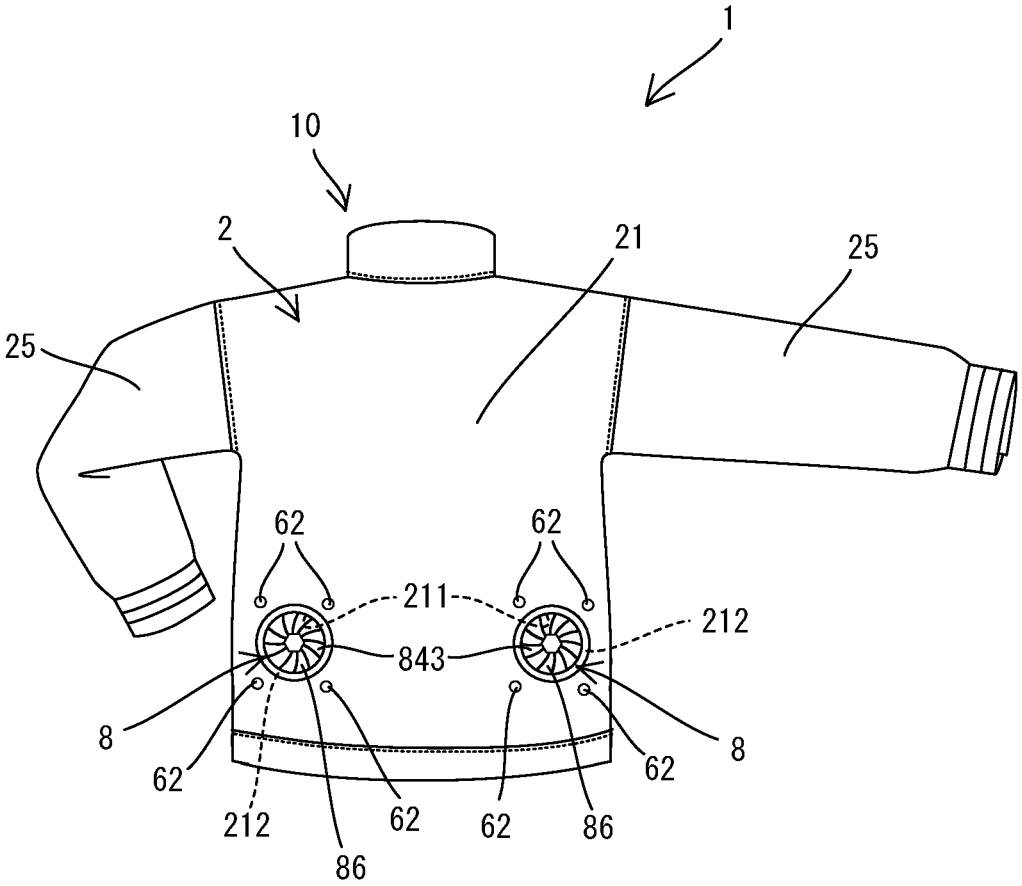
FIG. 1 is an explanatory view of a jacket seen from a back side in a state in which a fan unit is attached to a main body, while a heat-insulation liner is detached.
Figure 2:
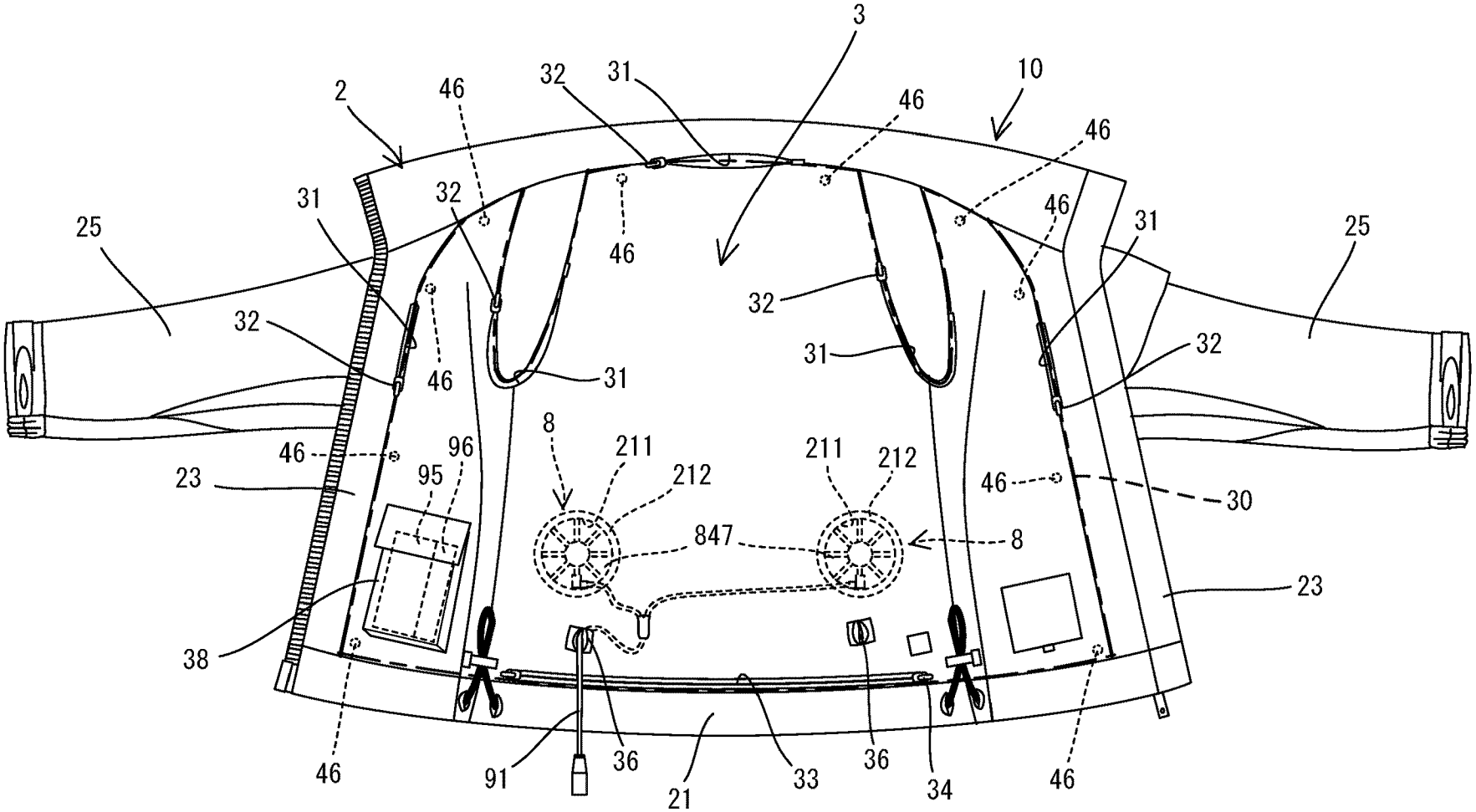
FIG. 2 is an explanatory view of the jacket shown in FIG. 1 seen from a front side in a state in which a front of the jacket is opened.

Firstly, a general configuration of the jacket 1 will be described. The jacket 1 of the present embodiment shown in FIG. 1 and FIG. 2 is an example of a garment that is also called a ventilation garment, an air-conditioning garment, or a cooling garment. The jacket 1 is configured such that fan units 8, which deliver air, can be detachably attached to the jacket 1.

As shown in FIG. 1 and FIG. 2, the jacket 1 has a main body 10 including an outer fabric 2 and an inner fabric 3. Under a high-temperature environment, the fan units 8 are attached to the jacket 1, and air is delivered by the fan units 8 in a state in which a wearer wears the jacket 1. Air sucked from inlets of the fan unit 8 is delivered between the outer fabric 2 and the inner fabric 3 through outlets, and the air flows within an internal space 15 (see FIG. 3) formed between the outer fabric 2 and the inner fabric 3. Consequently, the inner fabric 3 is bulged to contact a body of the wearer (including a body of the wearer wearing underwear) and absorb sweat of the wearer. And then, the air flowing within the internal space 15 evaporates the sweat, which absorbs heat, provides cool feeling to the wearer. Further, the air flows out from the internal space 15 through the inner fabric 3 and promotes heat dissipation of the whole body, which also provides the cool feeling to the wearer.

Figure 4:
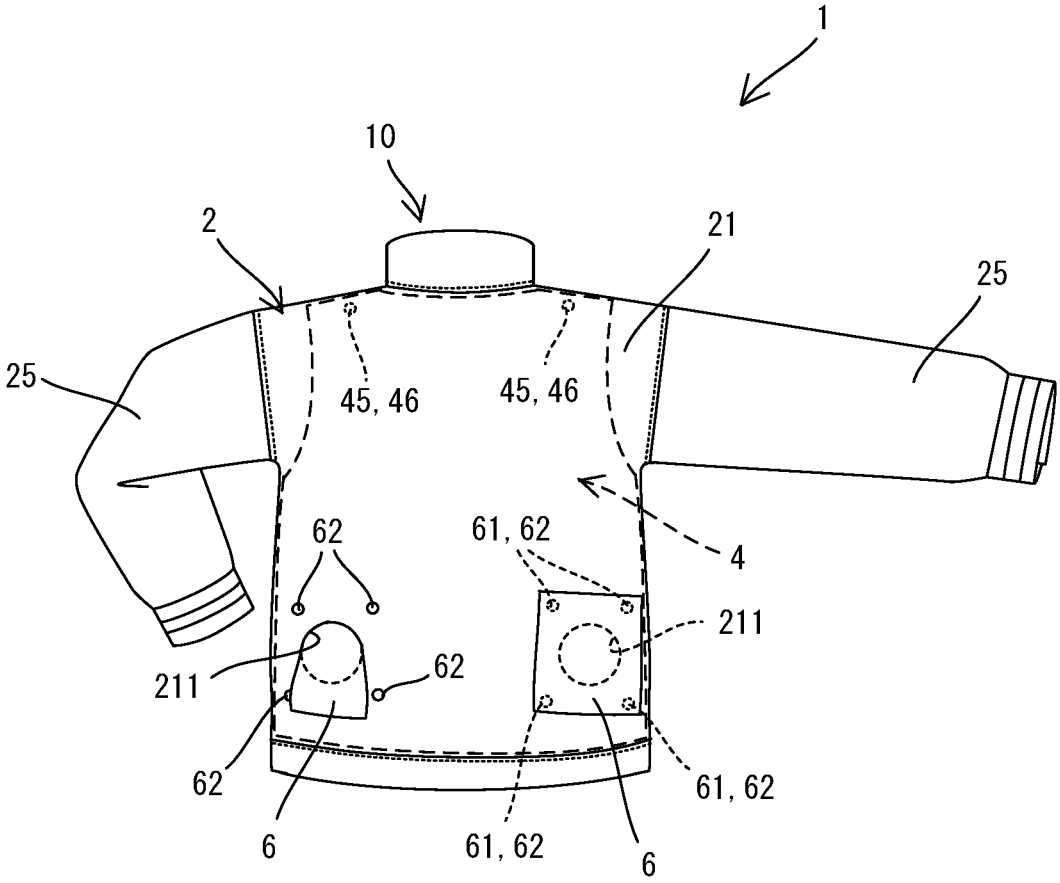
FIG. 4 is an explanatory view of the jacket seen from the back side in a state in which the heat-insulation liner is attached to the main body.

As shown in FIG. 4, the jacket 1 includes a heat-insulation liner 4 that can be detachably attached to the main body 10. When the heat-insulation liner 4 is attached to the main body 10, the jacket 1 of the present embodiment may function as a cold-weather garment. In this way, the jacket 1 of the present embodiment is formed to be used for not only cooling the body of the wearer under the high-temperature environment, but also keeping the body of the wearer warm under the low-temperature environment.

Hereinafter, a detailed configuration of the jacket 1 will be described.

Firstly, the main body 10 will be described. As shown in FIG. 1 and FIG. 2, in the present embodiment, the jacket 1 is formed as a front-open long-sleeve upper garment. The outer fabric 2 includes a back body part 21, a front body part 23 formed by a left body part and a right body part that can be connected via a slide fastener, and a sleeve 25.

Figure 3:
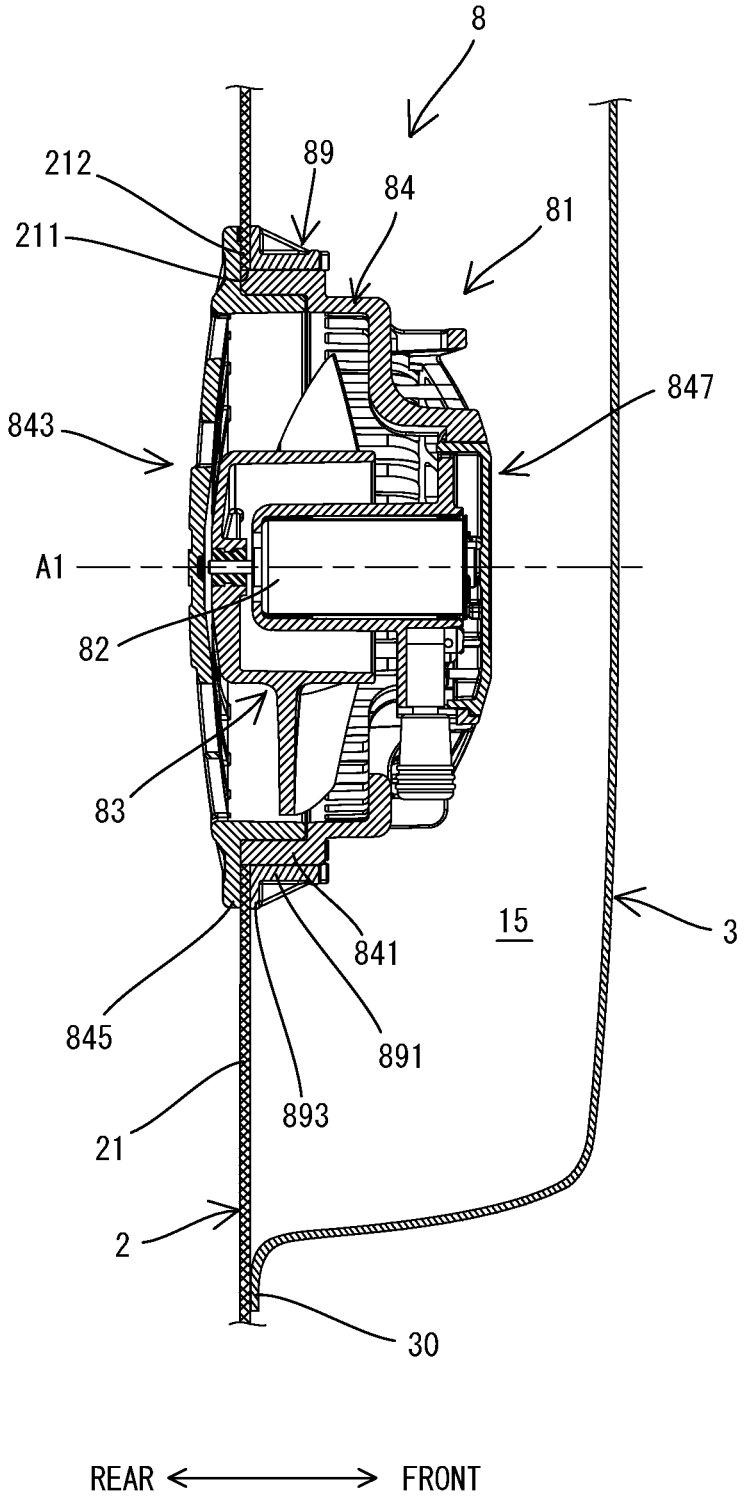
FIG. 3 is an explanatory cross-sectional view of the jacket and the fan unit shown in FIG. 1.

As shown in FIG. 1 and FIG. 3, the back body part 21 is configured such that two fan units 8 can be detachably attached to the back body part 21. More specifically, the back body part 21 has attachment holes 211 for the fan units 8, at two positions in its lower portion (specifically, a portion that covers an upper waist part of the wearer when the wearer wears the jacket 1). The attachment hole 211 is configured to allow the fan unit 8 to be partially inserted therethrough. More specifically, the attachment hole 211 is formed to have a diameter generally the same as a diameter of a cylindrical portion 841 of a housing 84 of the fan unit 8. The fan unit 8 may be fixed to the outer fabric 2 in a state in which the cylindrical portion 841 is inserted through the attachment hole 211. Hereinafter, a peripheral edge portion of the attachment hole 211 may also be called a fan-attachment part 212. The fan-attachment part 212 is preferably reinforced by a reinforcing material so that the fan unit 8 can be stably fixed thereto.

As shown in FIG. 4, the back body part 21 is configured such that a functional pocket 6, which can store an article, can be detachably attached to the back body part 21. The functional pocket 6 of the present embodiment is formed as a rectangular-shape bag. Snap buttons 61 are respectively fixed at four corners on one surface of the functional pocket 6. Correspondingly, snap buttons 62, which can be engaged with the snap buttons 61, are fixed on an outer surface of the back body part 21 (a surface facing an outer space when the jacket 1 is worn, or a surface arranged opposite to the body of the wearer). More specifically, four snap buttons 62 are arranged around each of the attachment holes 211. The functional pocket 6 can be attached to the outer surface of the back body part 21 through the engagement between the snap buttons 61 and 62.

As shown in FIG. 2, the inner fabric 3 is attached on an inner surface side of the outer fabric 2. More specifically, most of an edge part 30 of the inner fabric 3 is sewn onto the outer fabric 3 to cover the whole of the back body part 21 and the front body part 23 of the outer fabric 2. As shown in FIG. 3, the internal space 15 is formed between the outer fabric 2 and the inner fabric 3. An area of the inner fabric 3 surrounded by a connection part (edge part 30) connected to the outer fabric 2 is larger than an area of the outer fabric 2 surrounded by the connection part. With this configuration, the inner fabric 3 is allowed to easily bulge when the air is delivered by the fan units 8.

As shown in FIG. 2, portions of the edge part 30 not sewn onto the outer fabric 2 each forms an opening 31 through which the internal space 15 and the outside are communicated. In the present embodiment, the opening 31 is openable and closable by a slide fastener 32. The openings 31 are formed in a region facing a back of a neck of the wearer, regions facing parts between both armpits and both shoulder joints at a back side of the wearer, and a region facing a chest of the wearer (in particular, the pit of the stomach and a region above the pit). These regions correspond to portions of the body where the wearer can especially easily get cool feeling and thus realize superior effect for cooling the heated body (for example, portions where thick blood vessels are located just under the skin). The wearer can adjust the opening of the slide fastener 32 to adjust an air speed of the air that directly hits the portion through the opening 31.

An opening 33 that is linearly cut along the edge part 30 is formed in a lower end portion of the inner fabric 3 covering the back body part 21. The opening 33 is openable and closable by a slide fastener 34. When the fan unit 8 is attached to/detached from the fan-attachment part 212, the slide fastener 34 is opened and then the attaching/detaching operation is performed through the opening 33. Also when the heat-insulation liner 4 (see FIG. 5 and FIG. 6) is attached/detached, the attaching/detaching operation is performed through the opening 33. Further, when the jacket 1 is worn, the slide fastener 34 is closed. Thus, the air can be prevented from leaking from the internal space 15 around the waist.

A pocket 38 is provided on a portion of the inner fabric 3 covering the right front body part. The pocket 38 can store a battery holder 96 to which a rechargeable battery 95 serving as a power source for the fan units 8 is attached. Further, openings 36 are formed in the inner fabric 3 below the portions facing the two fan-attachment parts 212, respectively. A cable 91 for connecting the fan unit 8 and the battery holder 96 can be inserted through each of the openings 36. The battery holder 96 of the present embodiment is provided with a controller that controls driving of a motor 82, and an operation button for inputting instructions of the start and stop of the driving of the fan unit 8 (motor 82) and for inputting the setting for a air volume of a fan 83 (rotation speed of the motor 82). The battery 95 can be used as a power source for various power tools (screw driver, hammer drill, and the like). The configurations of the battery holder 96 and the battery 95 are well-known, and therefore the detailed description and the illustration thereof are omitted here.

In the present embodiment, each of the outer fabric 2 and the inner fabric 3 is a woven fabric formed of chemical fibers. A fabric having low air permeability is adopted in the outer fabric 2, in order to suppress leakage of the air from the internal space 15. Further, the outer fabric 2 has superior water resistance and superior moisture permeability. The air permeability of the inner fabric 3 is higher than that of the outer fabric 3, but still set to be relatively low. More specifically, the air permeability of the inner fabric 3 is set such that the pressure of the air delivered to the internal space 15 can be kept relatively higher to some extent than the atmospheric pressure and the air in the internal space 15 can flow out gently to the outside through the inner fabric 3. Further, the inner fabric 3 has superior water absorption rate and superior quick-drying property.

Further, the main body 10 has a structure for positioning and holding the heat-insulation liner 4 in the position relative to the main body 10. More specifically, snap buttons 46 for attaching the heat-insulation liner 4 are fixed at ten positions on inner surfaces (a surface located on a side of the body of the wearer when the jacket 1 is worn) of the back body part 21 and the front body part 23 of the outer fabric 2, along a connection part connected to the inner fabric 3.

Figure 5:
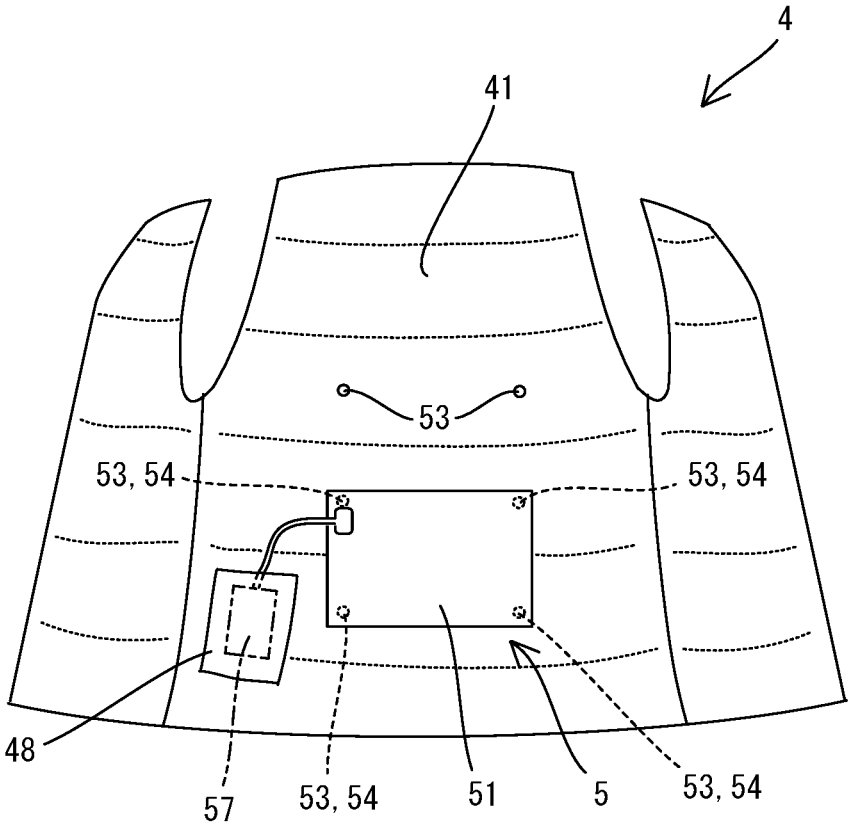
FIG. 5 is an explanatory view of the heat-insulation liner seen from a front side.
Figure 6:
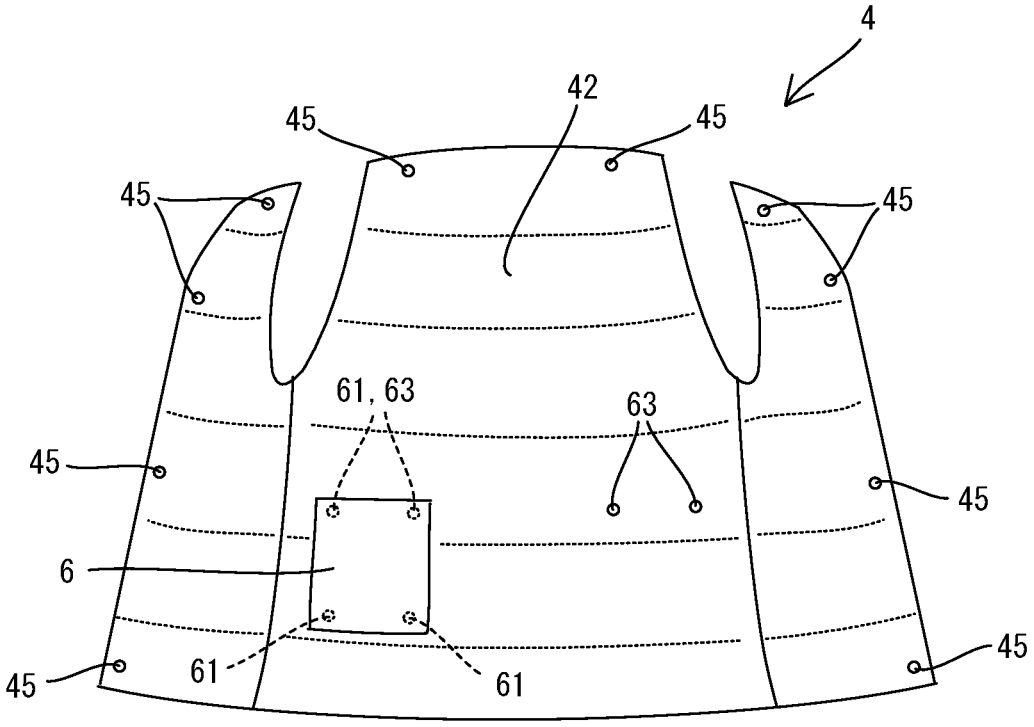
FIG. 6 is an explanatory view of the heat-insulation liner seen from a back side.

Hereinafter, the detailed configuration of the heat-insulation liner 4 formed to be detachably attachable to the main body 10 will be described. In the present embodiment, the heat-insulation liner 4 may be disposed between the outer fabric 2 and the inner fabric 3, namely, disposed in the internal space 15. Thus, the heat-insulation liner 4 is formed to fit the internal space 15. More specifically, as shown in FIG. 5 and FIG. 6, the heat-insulation liner 4 is formed in a shape generally corresponding to the back body part 21 and the front body part 23 of the outer fabric 2 (see FIG. 2). Although the detailed illustration is omitted, in the present embodiment, the heat-insulation liner 4 is formed by sewing two fabrics with a batting serving as a heat insulation material sandwiched therebetween. In the present embodiment, polyester cotton is used for the batting. Hereinafter, one of two surfaces of the heat-insulation liner 4 arranged to face the inner fabric 3 is called a front surface 41 and the other surface arranged to face the outer fabric 2 is called a back surface 42.

As shown in FIG. 5, the heat-insulation liner 4 is formed such that a heater 5 having a heat generator can be detachably attached to the heat-insulation liner 4. In the present embodiment, a rectangular sheet-like so-called fabric heater having a conductive fabric 51 and electrodes (not shown) is adopted as the heater 5. A configuration of such a fabric heater is well-known, and therefore the description thereof is omitted here. In the present embodiment, snap buttons 53 and 54 that can be engaged with each other are formed on the front surface 41 of the heat-insulation liner 4 and one surface of the fabric 51 of the heater 5, respectively. More specifically, four snap buttons 54 are respectively arranged at four corners on the one surface of the fabric 51 of the heater 5. Further, six snap buttons 53 are fixed on portions, which correspond to the back body part, on the front surface 41 of the heat-insulation liner 4. The six snap buttons 53 are arranged such that three buttons are aligned in an up-down direction and two rows of the three buttons are arranged side-by-side in a left-right direction. The four snap buttons 54 of the heater 4 may be engaged with upper four snap buttons 53 or lower four snap buttons 53 among the six snap buttons 53, so that the heater 5 is attached to the heat-insulation liner 4. Thus, in the present embodiment, two positions are set as attachment positions for the heater 5 to the heat-insulation liner 4.

Further, in the present embodiment, the heater 5 is connected to a rechargeable battery 57 serving as a power source, via a connector and a cable. A pocket 48 that can store the battery 57 is sewn onto the front surface 41 of the heat-insulation liner 4, adjacent to the attachment positions of the heater 5.

As shown in FIG. 6, snap buttons 45 for attaching the heat-insulation liner 4 to the main body 10 are fixed at ten positions on the back surface 42 of the heat-insulation liner 4 along an edge portion of the heat-insulation liner 4. The snap buttons 45 can be engaged with the snap buttons 46 (see FIG. 2) arranged on the inner surface of the outer fabric 2, and respectively arranged at positions corresponding to the snap buttons 46. With the engagement between the snap buttons 45 and 46, the heat-insulation liner 4 can be positioned relative to the main body 10 (outer fabric 2) and held so as to prevent a positional shift.

The heat-insulation liner 4 is configured such that the functional pocket 6 can be detachably attached to the heat-insulation liner 4. More specifically, four snap buttons 63 are fixed on the back surface 42 of the heat-insulation liner 4. In the present embodiment, two snap buttons 63 are arranged above each region that faces the attachment hole 211 (see FIG. 4) in the back body part 21 when the heat-insulation liner 4 is attached to the main body 10 within the internal space 15. The functional pocket 6 can be attached to the back surface 42 of the heat-insulation liner 4 through the engagement between the snap buttons 61 and 63. Although the functional pocket 6 has four snap buttons 61, only upper two of the four snap buttons 61 can be engaged with the snap buttons 63. Thus, only the upper end portion of the functional pocket 6 can be attached to the heat-insulation liner 4.

Hereinafter, a configuration of the fan unit 8 that is configured to be detachably attachable to the jacket 1 will be described. As shown in FIG. 3, the fan unit 8 includes a main body 81, and a ring member 89 that is formed separately from the main body 81 and that is detachably attachable to the main body 81.

Firstly, the main body 81 will be described. The main body 81 is mainly formed by the motor 82, the fan 83, and a housing 84 that houses the motor 82 and the fan 83.

The motor 82 and the fan 83 are arranged coaxially in the housing 84. In the present embodiment, a direct current (DC) motor with a brush is adopted as the motor 82. The fan 83 is formed as an axial fan having a plurality of blades. The fan 83 may be rotated integrally with a motor shaft around a rotation axis A1 along with the driving of the motor 82.

The housing 84 includes the cylindrical portion 841 to which the ring member 89 may be attached, an intake part 843 having the inlets, a flange 845 formed around the intake part 843, and an discharge part 847 having the outlets. The cylindrical portion 841 is a portion that is formed in a cylindrical shape, and arranged coaxially with the motor 82 and the fan 83. Although the detailed illustration is omitted, a male thread portion, which can be threadedly engaged with a female thread portion formed on an inner peripheral surface of the ring member 89, is formed on an outer peripheral surface of the cylindrical portion 841. The intake part 843 is arranged to cover one of two open ends of the cylindrical portion 841 on an intake side of fan 83. The inlets extend through the intake part 843 in a direction of the rotation axis A1. The flange 845 is arranged to protrude radially outward from the outer periphery of the intake part 843. The discharge part 847 is formed in a circular dome shape as a whole, and arranged to cover the other of the two open ends of the cylindrical portion 841 on a discharge side of the fan 83. The outlets extend through the discharge part 847 in the direction of the rotation axis A1 and also in a direction crossing the rotation axis A1.

Next, the ring member 89 will be described. The ring member 89 is mainly formed by a cylindrical portion 891, and a flange 893. The cylindrical portion 891 is formed as a short cylindrical body configured to be detachably attached to the outer periphery of the cylindrical portion 841 of the main body 81. Although the detailed illustration is omitted, in the present embodiment, the female thread portion is formed on the inner peripheral surface of the cylindrical portion 891. When the female thread portion is threadedly engaged with the male thread portion formed on the outer peripheral portion of the cylindrical portion 841, the ring member 89 is coaxially attached to the main body 81. The flange 893 is formed to protrude radially outward from one end portion of the cylindrical portion 841 in the axial direction. An outer diameter of the flange 893 is generally the same as an outer diameter of the flange 845 of the main body 81.

Hereinafter, use modes of the jacket 1 will be described.

As shown in FIG. 1 and FIG. 2, under the high-temperature environment, the jacket 1 may be used in a state in which the heat-insulation liner 4 is detached from the main body 10 and the fan units 8 are attached to the fan-attachment parts 212. In a case in which the heat-insulation liner 4 has been attached (see FIG. 4), the wearer first opens the slide fastener 34 provided in the lower end portion of the inner fabric 3, and then decouples the snap buttons 45 and 46 to detach the heat-insulation liner 4 from the outer fabric 2 and removes the heat-insulation liner 4 through the opening 33.

Further, the wearer attaches the fan units 8 to the fan-attachment parts 212. The wearer firstly detaches the ring member 89 from the main body 81 and then inserts a side of the discharge part 847 of the main body 81 into the attachment hole 211 of the jacket 1. With this, the fan-attachment part 212 (outer fabric 2) is arranged in front of the flange 845. Further, the wearer attaches the ring member 89 to the main body 81 through the opening 33. Specifically, as shown in FIG. 3, the wearer screws the ring member 89 (cylindrical portion 891) onto the main body 81 (cylindrical portion 841) up to a position where the fan-attachment part 212 (outer fabric 2) is held between the outer flange 845 and the inner flange 893. When the fan unit 8 is attached in such a way, the outlets are disposed between the outer fabric 2 and the inner fabric 3 to face the inner fabric 3. Thereafter, as shown in FIG. 2 the wearer draws the cable 91 connected to the fan unit 8 to the inner side of the inner fabric 3 through the opening 36 and connects the cable 91 to a cable (not shown) connected to a battery holder 96, and then the wearer closes the slide fastener 34.

Further, the wearer may open the slide fastener 32 of the opening 31 as needed, corresponding to a portion where the wearer want to cool by the air flowing out from the internal space 15 and directly hitting the portion, among the back of the neck, the parts between both armpits and both shoulder joints at the back side, and the chest.

When the wearer inputs a driving start instruction through an operation button (not shown) of the battery holder 96, the driving of the fan units 8 is started. The air delivered to the internal space 15 by the fan units 8 causes the inner fabric 3 to bulge in a direction away from the outer fabric 2 (namely, toward the body of the wearer) (see FIG. 3). Consequently, at least a portion of the inner fabric 3 contacts the body of the wearer and absorbs the sweat, so that the air flowing between the outer fabric 2 and the inner fabric 3 evaporates the sweat. The portion of the inner fabric 3 contacting the body exchanges heat efficiently, and thereby the wearer can obtain cool feeling.

The air delivered into the internal space 15 flows out from the opening(s) 31 opened by opening the slide fastener(s) 32, and the air can provide the cool feeling to the wearer and efficiently cool the heated body. Further, flowability of the air within the internal space 15 is secured, so that the sweat absorbed into the inner fabric 3 can be evaporated efficiently. Further, the inner fabric 3 is formed by a fabric that allows the air to pass therethrough to some extent, and thereby the air passing a region of the inner fabric 3 not in close contact with the body of the wearer can promote heat dissipation of the body. This configuration can also provide the cool feeling to the wearer.

On the other hand, under the low-temperature environment, as shown in FIG. 4, the jacket 1 may be used in a state in which the heat-insulation liner 4 is attached to the main body 10. Further, in a case in which the wearer desires more warmth, the jacket 1 may be used in a state in which the heater 5 is attached to the heat-insulation liner 4 (see FIG. 5). Although the fan units 8 may not be necessarily detached from the jacket 1, the comfortability of the jacket 1 when it is worn can be improved when the fan units 3 are detached. The wearer may open the slide fastener 34 (see FIG. 2) in the lower end portion of the inner fabric 3 and remove the ring member 89 (cylindrical portion 891) through the opening 33. And then, the wearer may pull off the main body 81 that has been inserted through the attachment hole 211 from the outside, so that the fan unit 8 can be detached.

The wearer inserts the heat-insulation liner 4 into the internal space 15 through the opening 33, and engages the snap buttons 45 and 46 each other, so as to attach the heat-insulation liner 4 to the main body 10 (outer fabric 2). As described above, the heat-insulation liner 4 is formed in a shape that generally corresponds to the back body part 21 and the front body part 23, and therefore, at this time, the wearer can easily position the heat-insulation liner 4 relative to the outer fabric 2. The heat-insulation liner 4 attached to the outer fabric 2 covers the two attachment holes 211 from the inside. Consequently, cool air from the outside can be prevented from passing through the attachment holes 211 and hitting the body of the wearer. In a case in which the heater 5 is used, the wearer may attach the heater 5 to the heat-insulation liner 4 via the snap buttons 53 and 54 before inserting the heat-insulation liner 4 into the internal space 15 (see FIG. 5). At this time, the wearer can select a desired position among the two attachment positions of the heater 5. Further, although the slide fasteners 32 (see FIG. 2) may be selectively opened under the high-temperature environment, the slide fasteners 32 may be closed under the low-temperature environment, so that warm air can be prevented from leaking through the openings 31 and thus a heat insulation effect can be enhanced.

Further, as shown in FIG. 6, the wearer can attach the functional pocket 6 in advance to the back surface 42 of the heat-insulation liner 4 via the snap buttons 61 and 63, so as to use the functional pocket 6 for positioning and holding the heat-insulation liner 4 relative to the main body 10. Specifically, as shown in FIG. 4, the wearer may draw a lower portion of the functional pocket 6 attached to the back surface 42, to the outside through the attachment hole 211, so that the functional pocket 6 can be engaged with the attachment hole 211. In this case, the heat-insulation liner 4 is engaged with the outer fabric 2 not only at the edge portion via the snap buttons 45 and 46, but also at a region away from the edge portion (a region corresponding to the back body part) via the functional pocket 6 and the attachment hole 211.

Further, as shown in FIG. 4, the functional pocket 6 may be attached to the back body part 21 of the outer fabric 2 using the snap button 63, instead of the heat-insulation liner 4, so that the attachment hole 211 can be covered from the outside. Consequently, the warm air can be prevented from leaking from the internal space 15 through the attachment hole 211, and thereby the heat insulation effect can be enhanced. Further, outer appearance of the jacket 1 can be improved.

In this way, the wearer can use the jacket 1 as a cold-weather garment by attaching the heat-insulation liner 4 having the bating serving as a heat insulation material. In a case in which the heater 5 is attached to the heat-insulation liner 4, not only the heat insulation function (heat retaining function) can be achieved by the heat-insulation liner 4, but also a warming function can be added to the jacket 1 by the heat generator, so that the body of the wearer can be warmed efficiently.

As described above, the jacket 1 of the present embodiment can be used in a first mode in which the fan unit 8 is attached (a mode in which a cooling function is added), a second mode in which only the heat-insulation liner 4 is attached (a mode in which the heat insulation and heat retaining function is added), and a third mode in which the heat-insulation liner 4 is attached together with the heater 5 (a mode in which the warming function is further added). Thus, under the high-temperature environment, the jacket 1 can be used in the first mode to cool the body of the wearer. In addition to this, under the low-temperature environment, the jacket 1 can be used in the second mode or the third mode as a cold-weather garment. In this way, the jacket 1 of the present embodiment can provide comfortability when it is worn not only under the high-temperature environment but also under the low-temperature environment. Further, the wearer can set the desired mode of the jacket 1 easily through the attaching/detaching of the fan units 8, the attaching/detaching of the heat-insulation liner 4, and the attaching/detaching of the heater 5. Further, by selectively opening/closing the opening(s) 31 using the slide fastener(s) 32, in a case in which the jacket 1 is used in the first mode, the specific portion of the body of the wearer can be selectively cooled, while in a case in which the jacket 1 is used in the second mode or the third mode, the deterioration of the heat insulation property (heat retaining property) can be prevented.

In the present embodiment, the internal space 15 formed between the outer fabric 2 and the inner fabric 3 is utilized for allowing the air delivered by the fan units 8 to flow therewithin, in order to cool the body of the wearer under the high-temperature environment, while the internal space 15 is utilized for attaching the heat-insulation liner 4 to the main body 10 under the low-temperature environment. Thus, the internal space 15 can be effectively utilized for different purposes in respective modes. Further, the heat-insulation liner 4 can be securely held, without being dropped off from the main body 10, by arranging the heat-insulation liner 4 in the internal space 15. Further, when the heater 5 is attached to the heat-insulation liner 4, the heater 5 is not exposed to a body side. Thus, the possibility can be reduced that the heater 5 falls off from the heat-insulation liner 4 or the connector falls off from the heater 5.

Further, in the present embodiment, the heat-insulation liner 4 is fixed to the main body 10 by the snap buttons 45 and 46. In this way, the heat-insulation liner 4 is positioned and held relative to the main body 10 by the snap buttons 45 and 46, and thereby the positional relation therebetween can be stabilized. Specifically, the heat-insulation liner 4 can be prevented from moving within the internal space 15 to be eccentrically arranged in a certain region by the motion of the wearer. Therefore, the comfortability in wearing of the jacket 1 can be improved. In particular, in the present embodiment, the heat-insulation liner 4 can be positioned and held relative to the main body 10 also by the functional pocket 6 attached to the back surface 42 of the heat-insulation liner 4. With this configuration, the positional relation between the heat-insulation liner 4 and the main body 10 can be kept further stably. Further, the functional pocket 6 can be used for storing an article, or concealing the attachment hole 211.

Further, the functional pocket 6 of the present embodiment can be selectively detachably attached to several positions on the main body 10. Therefore, the functional pocket 6 can show various functions such as a positioning function and the concealing function of the attachment hole 211 described above, in accordance with the attached position, not to mention the storing function for an article.

The correspondence relationships between the structural elements of the embodiment described above and the features in the present invention are described below. The jacket 1 is one example of "a garment" of the present invention. The fan unit 8 is one example of "a blower device". The main body 10, the outer fabric 2, and the attachment hole 211 are one example of "a main body", "an outer fabric", and "an attachment hole" of the present invention, respectively. The heat-insulation liner 4 (batting) is one example of "a heat insulation material" of the present invention. The heater 5 is one example of "a heat generator" of the present invention. Each of the snap buttons 45, 46 and the functional pocket 6 is one example of "a positioning part" of the present invention. The inner fabric 3 and the internal space 15 are one example of "an inner fabric" and "an internal space" of the present invention, respectively. The opening 31 is one example of "an opening" of the present invention. The functional pocket 6 is one example of "a pocket" of the present invention.

The embodiment described above is merely an example, and therefore the garment according to the present invention is not limited to the configuration of the jacket 1 exemplarily described. For example, the modifications described below may be adopted. Only one or a plurality of these modifications can be adopted to be combined with the jacket 1 described in the embodiment or each claimed invention.

The garment according to the present invention is not necessarily formed as a front-open long-sleeve upper garment such as the jacket 1. For example, the garment according to the present invention may be suitably formed as an upper garment with a hood, a sleeveless upper garment (vest), so-called overalls in which the upper garment and trousers are connected, or a pair of trousers. The usage of the garment is not especially limited, and therefore, for example, the garment may be formed as work wear, sportswear, leisure wear, firefighter uniforms, protective wear, and an operation gown.

The main body 10 may not be necessarily provided with the inner fabric 3, and therefore the main body 10 may be formed by the outer fabric 2 only. In this case, the heat-insulation liner 4 may be configured to be detachably attachable to the inner surface of the outer fabric 2. Further, the inner fabric 3 may be attached to cover only the inner surface of the back body part 21, or to also cover the inner surfaces of the sleeves 25, in addition to the back body part 21 and the front body part 23. An attachment method for attaching the inner fabric 3 to the outer fabric 2 is not limited to the sewing, and therefore bonding using an adhesive or ultrasonic welding may be adopted. In a case in which the main body 10 includes the outer fabric 2 and the inner fabric 3, the heat-insulation liner 4 may be, for example, detachably attached to the front surface of the inner fabric 3 (a surface located on the side of body of the wearer), instead of being disposed in the internal space 15. Further, a kind and the air permeability of the outer fabric 2 and the inner fabric 3, the number, the size, and the arranged position(s) of the opening(s) 31, and the presence/absence of the slide fastener (s) 32 may be modified as needed.

The size and the shape of the heat-insulation liner 4 are not necessarily limited to the example described in the above embodiment, and therefore the size and the shape thereof may be modified as needed, in accordance with the garment to which the heat-insulation liner 4 is attached. For example, the heat-insulation liner 4 may be formed in a shape corresponding to only the back body part 21.

As the heat insulation material used in the heat-insulation liner 4, a batting formed of a material other than polyester cotton, feather, and the like may be adopted. In a case in which the batting is adopted, for example, cotton formed of other chemical fibers such as nylon fibers (so-called chemical fiber cotton), cotton formed of natural fibers such as cotton fibers, or cotton formed of mixed fibers thereof may be adopted. Further, an air layer may be suitably adopted as the heat insulation material. In this case, for example, an air-filled bag member formed by a resin film with a check valve, or a resin sheet with air bubbles contained therein may be arranged in the internal space 15, instead of the heat-insulation liner 4. Such an air layer can also show superior heat insulation effect.

The structure for positioning and holding the heat-insulation liner 4 relative to the main body 10 is not limited to the snap buttons 45 and 46. For example, in a case in which the heat-insulation liner 4 is fitted to the internal space 15 as described in the above embodiment, the heat-insulation liner 4 may be held between the outer fabric 2 and the inner fabric 3 without using a fastening means (fastener) such as the snap buttons 45 and 46, or alternatively the heat-insulation liner 4 may be held by only the engagement between the functional pocket(s) 6 and the attachment hole(s) 211 as described above. Further, instead of the functional pocket 6, a pocket fixed to the heat-insulation liner 4 by means of sewing or bonding may be engaged with the attachment hole 211. Also in this case, the pocket can be arranged on the outer side of the outer fabric 2 through the attachment hole 211, and thereby the pocket can be used for not only positioning but also concealing the attachment hole 211 and storing an article. Further, a fastening means other than the snap buttons 45 and 46 (for example, a hook-and-loop fastener, a slide fastener, a hook, and a button) may be adopted. In a case in which the snap buttons 45 and 46 or other fastening means are adopted, the number and the arranged positions thereof are not limited to the examples described in the above embodiment, and therefore they may be modified as needed.

The heater 5 is not limited to the fabric heater exemplarily described in the above embodiment. For example, a planar heat generator (film heater) or the like may be suitably adopted. The heat generator may be assembled in the heat-insulation liner 4 so as not to be detachable from the heat-insulation liner 4. Further, the heater 5 may be detachably attached to the main body 10 (for example, the inner fabric 3), instead of the heat-insulation liner 4. In a case in which the heater 5 can be detachably attached to the heat-insulation liner 4 or the main body 10, the heat-insulation liner 4 or the main body 10 can be cleaned after detaching the heater 5, and thereby usability thereof may be improved. The structure for attaching the heater 5 to the heat-insulation liner 4 or the main body 10 is not limited to the snap buttons 53 and 54, and therefore other fastening means (for example, a hook-and-loop fastener, a slide fastener, a hook, and a button) may be adopted.

The number of the functional pockets 6, the size and the shape of the functional pocket 6, the attachable position of the functional pocket 6 on the main body 10 or the heat-insulation liner 4, and the structure for attaching the functional pocket 6 are not limited to those exemplarily described in the above embodiment, and therefore they may be modified as needed. For example, the structure for attaching the functional pocket 6 may be modified to be similar to the structure for attaching the heater 5. Further, the functional pocket 6 may be omitted.

The attaching position of the fan unit 8 and the number of the fan units 8 attachable to the garment according to the present invention are not limited to those exemplarily described in the above embodiment, and therefore they may be modified as needed. For example, the jacket 1 may have the attachment hole(s) 211 for the fan unit(s) 8 on the front body part 23 instead of the back body part 21. Further, the number of the attachment holes 211 (namely, the number of the attachable fan units 8) may be one, or three or more.

The configuration of the fan unit 8 may be modified as needed. For example, a compact and high output brushless motor may be adopted as the motor 82. A plurality of the fans 83 may be housed in one housing 84. In this case, a plurality of the motors 82 may be provided, corresponding to the number of the fans 83.

Further, the attaching method for attaching the fan unit 8 to the outer fabric 2 is not limited to the example described in the above embodiment. For example, a locking piece having flexibility may be provided on one of the housing 84 (cylindrical portion 841) and the ring member 89, and a recess that can be locked with the locking piece may be provided on the other. In this case, the ring member 89 is fitted onto the housing 84 in the direction of the rotation axis A1 and the locking piece is locked with the recess, so that the attaching operation is completed. Alternatively, an L-shaped guide groove may be formed on the outer peripheral surface of the housing 84 (cylindrical portion 841) and a projection that can be engaged with the guide groove may be formed on the inner peripheral surface of the ring member 89. In this case, the ring member 89 is fitted to the housing 84 in the direction of the rotation axis A1 in a state in which the projection is arranged in the guide groove, and then the ring member 89 is rotated in a circumferential direction, so that the attaching operation is completed.

The fan unit 8 can be detached from the jacket 1, and therefore the fan unit 8 can be used for another purpose. For example, in a case in which the jacket 1 is used as leisure wear for outdoor leisure, the fan unit 8 detached from the jacket 1 can be used for ventilating a tent. In this case, similar to the attachment hole 211 of the jacket 1, an opening having a diameter substantially the same as the diameter of the cylindrical portion 841 may be formed on the tent, and an edge of the opening may be reinforced by a reinforcing material, so that the fan unit 8 can be attached to the tent. Also in this case, the power may be supplied to the fan unit 8 from the battery 95. Further, the fan unit 8 can be used as a blower for making a fire in the open air, or a portable fan.

REFERENCE SIGNS LIST

1: Jacket, 10: Main body, 15: Internal space, 2: Face fabric, 21: Back body part, 211: Attachment hole, 212: Fan-attachment portion, 23: Front body part, 25: Sleeve, 3: Lining, 30: Edge part, 31: Opening, 32: Slide fastener, 33: Opening, 34: Slide fastener, 36: Opening, 38: Pocket, 4: Heat-insulation liner, 41: Front surface, 42: Back surface, 45: Snap button, 46: Snap button, 48: Pocket, 5: Heater, 51: Fabric, 53: Snap button, 54: Snap button, 57: Battery, 6: Functional pocket, 61: Snap button, 62: Snap button, 63: Snap button, 8: Fan unit, 81: Main body, 82: Motor, 83: Fan, 84: Housing, 841: Cylindrical portion, 843: Inlet part, 845: Flange, 847: Outlet part, 89: Ring member, 891: Cylindrical portion, 893: Flange, 91: Cable, 95: Battery, 96: Battery holder, A1: Rotation axis

The invention claimed is:

1. A garment comprising:

a main body configured to cover at least a portion of a body of a wearer of the garment; and a heat insulation material (i) configured to cover at least a part of the portion of the body and (ii) having a known insulating capability, wherein:

the main body includes (i) an outer fabric having an attachment hole configured to receive and retain a blower device and (ii) an inner fabric attached to an inner surface of the outer fabric along an edge part of the inner fabric;

the main body is configured such that the inner fabric is closer to the body of the wearer than the outer fabric when the garment is worn by the wearer;

an internal space is defined by the outer fabric, the inner fabric and the edge part of the inner fabric;

the internal space is configured such that, when the blower device is attached to the garment and operating, the internal space (i) receives air from an outlet of the blower and (ii) allows the air to flow throughout the internal space;

the heat insulation material is a separate member from the outer fabric and the inner fabric;

the main body and the heat insulation material are configured such that the heat insulation material is removably attachable to the main body in the internal space; and the heat insulation material has a positioning part configured to (i) be received through the attachment hole and (ii) engage the outer fabric adjacent to the attachment hole to hold the heat insulation material at a predetermined position relative to the main body.

2. The garment according to claim 1, wherein the heat insulation material includes a batting having the known insulating capability.

3. The garment according to claim 1, wherein the heat insulation material and the outer fabric are configured such that the heat insulation material covers the attachment hole when the heat insulation material is attached to the main body in the internal space.

4. The garment according to claim 1, wherein at least one of the main body and the heat insulation material is configured such that a heat generator is detachably attachable to the at least one of the main body and the heat insulation material.

5. The garment according to claim 1, wherein the positioning part is a pocket that is (i) configured to store an article and (ii) on an outer side of the outer fabric when the positioning part is received through the attachment hole.

6. The garment according to claim 1, wherein:

the main body has an opening that allows the internal space to communicate with an outside, and the opening is configured to be openable and closeable.

7. The garment according to claim 1, further comprising at least one pocket configured to be detachably attachable to at least one of the main body and the heat insulation material.

8. A garment comprising:

a main body configured to cover at least a portion of a body of a wearer of the garment; and a heat insulation material (i) configured to cover at least a part of the portion of the body and (ii) having a known insulating capability, wherein:

the main body includes (i) an outer fabric having a first attachment hole and a second attachment hole, each of the first attachment hole and the second attachment hole is configured to receive and retain a blower device, and (ii) an inner fabric attached to an inner surface of the outer fabric along an edge part of the inner fabric;

the main body is configured such that the inner fabric is closer to the body of the wearer than the outer fabric when the garment is worn by the wearer;

an internal space is defined by the outer fabric, the inner fabric and the edge part of the inner fabric;

the internal space is configured such that, when the blower device is attached to the garment and operating, the internal space (i) receives air from an outlet of the blower and (ii) allows the air to flow throughout the internal space;

the main body has a slit that allows the internal space to communicate with an outside and that is configured to be openable and closeable;

the heat insulation material is a separate member from the outer fabric and the inner fabric;

the main body and the heat insulation material are configured such that the heat insulation material is removably attachable to the main body in the internal space;

the main body and the heat insulation material are configured such that an entirety of the heat insulation material fits in the internal space;

the first attachment hole and the second attachment hole are spaced apart from each other in a left-right direction of the garment when the garment is worn by a wearer;

the slit linearly extends in the left-right direction along the edge part of the inner fabric in a lower end portion of the inner fabric;

the slit is longer than a distance between the first attachment hole and the second attachment hole in the left-right direction;

a left end of the slit is leftward of a right edge of the first attachment hole, which is leftward of the second attachment hole; and a right end of the slit is rightward of a left edge of the second attachment hole.

9. The garment according to claim 8, wherein:

the outer fabric includes a back body panel configured to cover a back of the body of the wearer and a front body panel configured to cover a front of the body of the wearer; and the heat insulation material is a single member that is configured to cover at least a portion of the back body panel and at least a portion of the front body panel.

* * * * *